United States Patent [19]

Gibson et al.

[11] 4,357,998

[45] Nov. 9, 1982

[54] BETWEEN LANDING CAR DOOR SAFETY LOCK

[75] Inventors: George W. Gibson, Ramsey; Joseph P. Mahon, Cresskill, both of N.J.; John McAulay, Ardsley; Stanley M. Wolper, Massapequa Park, both of N.Y.

[73] Assignee: Otis Elevator Company, Farmington, Conn.

[21] Appl. No.: 315,079

[22] Filed: Oct. 6, 1981

Related U.S. Application Data

[63] Continuation of Ser. No. 120,443, Feb. 11, 1980, abandoned.

[51] Int. Cl.[3] ..... B66B 1/00

[52] U.S. Cl. ..... 187/49; 187/61; 187/57; 49/31

[58] Field of Search ..... 187/49, 57, 61, 50, 187/52 LC, 31, 32, 56; 49/116, 31

[56] References Cited

U.S. PATENT DOCUMENTS 1,838,524 12/1931 Brown ..... 187/61

FOREIGN PATENT DOCUMENTS 2449110 10/1974 Fed. Rep. of Germany ..... 49/31

*Primary Examiner*—H. Grant Skaggs
*Assistant Examiner*—Kenneth Noland
*Attorney, Agent, or Firm*—Robert E. Greenstien

[57] ABSTRACT

Between floors or landings the elevator car door may be opened allowing passengers to open the hall door. To prevent this from occurring, a stop apparatus is attached to the car door and hall door. This apparatus allows the car door to only be opened to a certain minimum acceptable distance when the car is above a predetermined distance above the landing.

9 Claims, 3 Drawing Figures

FIG.2
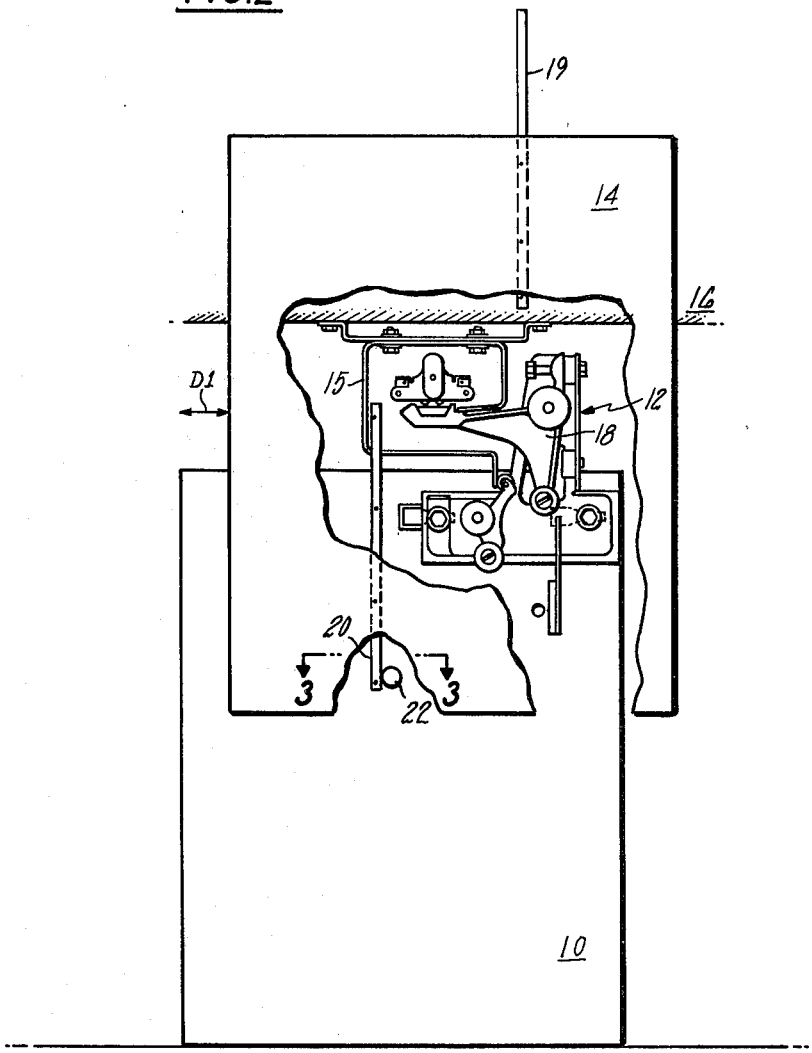
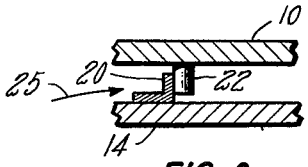
FIG.3

BETWEEN LANDING CAR DOOR SAFETY LOCK

This is a continuation of application Ser. No. 120,443 filed on Feb. 11, 1980 now abandoned.

TECHNICAL FIELD

This invention relates to elevator systems and, in particular, hall and car door interlocking apparatus for controlling the opening of car and hallway doors when the elevator car is between floors.

BACKGROUND ART

Most, if not all elevator systems are designed to allow the car doors to be manually opened by the passengers. This permits emergency exiting near floors and assists rescue. With the car door open, the hall door latch can be operated by the passengers to exit the car. If the car is substantially above the floor level (between floors), there is a large space leading to the shaftway between the bottom of the car and the floor. Passengers attempting to leave the car may step into that space while attempting to reach the floor. Thus the fact that the doors can be opened presents a potential for injury, albeit only in very rare, unusual circumstances.

U.S. Pat. No. 1,838,524 shows one type of safety device that only prevents opening the car door when the car is between floors, in addition to connecting the car and hall doors when the car is at a floor.

Consequently, there is an unmistakable need for a safety arrangement that prevents the occupants from opening the car doors, reaching the hall doors and pulling the hall doors back far enough so that they can try to leave when the car is too far from the floor. But an arrangement should still allow the passengers to open the car doors far enough to permit communication and passage of equipment, if required, and should allow passenger evacuation when the car is safely near the floor. The present invention provides such an arrangement.

DISCLOSURE OF INVENTION

According to the present invention, each hall door has a member which engages a member on the car to limit the opening of the car door when the car is above a certain distance above the floor. Thus, the car door can only be partially opened when the car is above that position.

In one embodiment of the invention, a bar extends vertically for some distace along the shaft side of the car door and also towards the hall door enough to block access to the space between the doors. A small stop is attached to the hall door at some horizontal distance behind the bar. The location of the bar and the stop are interrelated. The stop is located so that when the car is at the floor, the stop is above the bar, so that the car door may open and close completely, but, when the car is some distance above the floor, it strikes the bar as the car is opened. The horizontal distance between the stop and the door determines the maximum opening of the car door at that car position, and the length of the bar determines the safety zone, the distance between floors the car must move to clear the stop.

The invention thus provides a simple safety arrangement to limit the extent to which the car door may be opened by passengers. A feature is that existing elevator systems may be retrofitted to include the arrangement.

BRIEF DESCRIPTION OF DRAWINGS

FIG. 2 is also an elevated view of the car door, but partially cut away to expose the interlock of the present invention and also the hall door interlock and in this view the car is above the floor level;

FIG. 3 is a plan view of the two doors along the line 3—3 in FIG. 2.

BEST MODE FOR CARRYING OUT THE INVENTION

Figure 1:
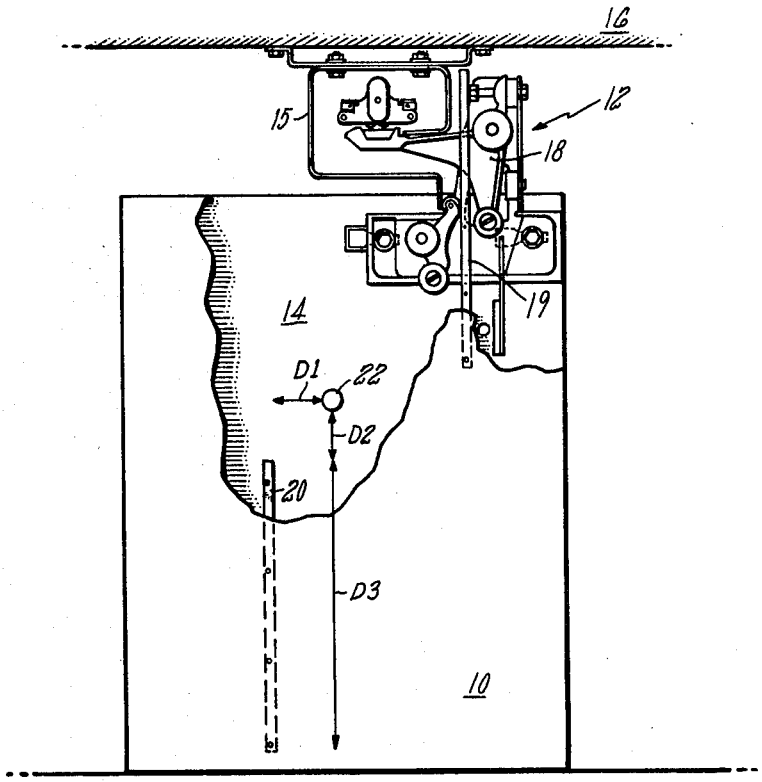
FIG. 1 is an elevated view of a car door partially cut away to expose the hall door interlock; and a concealed elevated view of the hall door and the interlock of the present invention between the two doors.

FIG. 1 shows a closed car door 10 and a hall door 14 concealed behind it. The car door is cut away to show an interlock 12 of the type shown in U.S. Pat. No. 3,638,762. This interlock includes a number 14 on the hall jamb 16 and an arm 18 on the hall door. The car door carries a bar or "cam" which rotates the arm to disengage the arm and member when the car door opens to simultaneously open the hall door. In FIG. 1 the car is at floor level and both doors are closed. Located between the two doors (see FIG. 3) is an interlock apparatus of this invention. This apparatus includes a vertical bar like member (auxiliary cam) 20 on the car door and a stop 22 on the hall door. The stop and bar engage (FIG. 2) to prevent car door opening beyond the distance D1 when the car is between D2 and D3 above the floor. D1−D2=the length of bar 20. Those safety distances are selected based upon the criteria that when the car is within the level zone (about 16 inches from the floor level) there is no requirement to prevent the passengers from opening the car door. Similarly, when the car is virtually to the jamb there is no need to provide that protection because that position (which is not shown), the space between the bottom of the car and the jamb, is too small for passengers to attempt to get out of the car.

The effect of the auxiliary cam 20 and the stop 22 is to prevent the car door from opening beyond the distance D1 which is determined by the distance between the auxiliary cam and the stop 22. But, in addition to preventing the car door from being opened beyond that distance, the presence of the rod blocks the path between the two doors to the interlock apparatus 12. It thus completely prevents an occupant from working hall interlock 12 (pulling the arm down) to release the hall door from the jam. If a passenger could do that, the hall door and car door could be simultaneously opened merely by pulling on the car door; that will transmit the opening force to the hall door through the auxiliary cam and post.

The auxiliary cam 20 may be an L bracket or I beam which is welded, bolted or otherwise fastened vertically to the shaft side of the car door. The stop 22 may be a bolt or rod portion which is bolted, welded or otherwise fastened to the hall door. If required, an alternative embodiment of the invention is constructed by placing the post 22 on the shaft side of the car door and the cam 20 on the shaft side of the hall door; in other words, merely reverse the placement of the auxiliary cam and the stop.

The invention thus provides absolute interlock apparatus; one that completely prevents the car door from being opened beyond an acceptable distance when the car is above a predetermined distance above the floor.

The member 20 and the post obviously can be easily installed on existing systems; thus the invention provides a system which is especially suited for retrofit applications.

Even though the invention has been shown in an embodiment used on a single slide car door, it obviously also can be used where there are two doors: center opening doors or telescoping doors. In either application the auxiliary cam and stop would be located on one or both of the doors in order to prevent them from opening beyond the selected distance D1.

In addition, the above may suggest, to one skilled in the art, still other modifications, variations, improvements in and to the embodiment which has been shown but nevertheless still embracing the true scope and spirit of the invention embodied therein and described in the claims that follow.

We claim:

1. An elevator system for transporting passengers between a plurality of floors, said system including a car that includes at least one sliding hall door, characterized by, an interlock apparatus for controlling the opening of the car door from either the floor or the car, comprising:

a bar-like member attached to the car door, and a stop member attached to the hall door, said bar-like member extending vertically for a selected distance from a first distance above the car floor level in the direction in which the car moves between the floors and also extending towards the hall door so that, when the car is adjacent thereto, said bar-like member substantially blocks access to the space between the car and hall door from the door opening that the doors provide, said stop member being a second distance above the floor level, said second distance being greater than said first distance, and also a third horizontal distance from said member in the space between the doors in the direction the car door opens, said second distance being such that said stop member is above said bar-like member when the car is within said second distance of the hall floor.

2. A system according to claim 1, characterized by said first member comprising a L-bracket.

3. A system according to claim 2, characterized by said second member comprising a pin.

4. An elevator system for transporting passengers between a plurality of floors, said system including a car that includes at least one sliding door and, on each floor, at least one sliding hall door, characterized by, an interlock apparatus for controlling the opening of the car door from either the floor or the car, comprising:

a bar-like member attached to the hall door, and a stop member attached to the car door, said bar-like member extending vertically for a selected distance from a first distance above the car floor level in the direction in which the car moves between the floors and also extending towards the hall door so that, when the car is adjacent thereto, said bar-like member substantially blocks access to the space between the car and hall door from the door opening that the doors provide, said stop member being a second distance above the car floor level, said second distance being greater than said first distance, and also a third horizontal distance from said bar-like member in the space between the doors in the direction the car door opens, said second distance being such that said stop member is above said bar-like member when the car is within said second distance of the hall floor.

5. A system according to claim 4, characterized by said first member comprising a L-bracket.

6. A system according to claim 5, characterized by said second member comprising a pin.

7. An elevator system for transporting passengers between a plurality of floors, said system including a car that includes at least two doors, one a sliding door on the car, the other a sliding door at the floor, characterized by, an interlock apparatus for controlling the opening of the car door from either the floor or the car, comprising:

a bar-like member attached to one door, and a stop member attached to the other door, said bar-like member vertically extending for a selected distance, when the car is at the floor, from a first distance above the floor level in the direction in which the car moves between the floors and also extending towards the other door to substantially block access to the space between the doors from the door opening that the doors provide, said stop member being, when the car is at the floor, a second distance above the floor level, said second distance being greater than said first distance, and also a third horizontal distance from said bar-like member in the space between the doors in the direction the car door opens, said second distance being such that said stop member is above said bar-like member when the car is within said second distance of the floor.

8. A system according to claim 7, characterized by said first member comprising a L-bracket.

9. A system according to claim 8, characterized by said second member comprising a pin.

* * * * *